US008424811B2

(12) United States Patent
Cruz-Sagredo Garcia

(10) Patent No.: US 8,424,811 B2
(45) Date of Patent: Apr. 23, 2013

(54) BARBED-TYPE MESH

(76) Inventor: Juan Maria Cruz-Sagredo Garcia, Salamanca (ES)

( * ) Notice: Subject to any disclaimer, the term of this patent is extended or adjusted under 35 U.S.C. 154(b) by 1283 days.

(21) Appl. No.: 10/564,426

(22) PCT Filed: Jun. 30, 2004

(86) PCT No.: PCT/ES2004/000306

§ 371 (c)(1),
(2), (4) Date: Jan. 11, 2006

(87) PCT Pub. No.: WO2005/005078

PCT Pub. Date: Jan. 20, 2005

(65) Prior Publication Data

US 2006/0186275 A1 Aug. 24, 2006

(30) Foreign Application Priority Data

Jul. 11, 2003 (ES) ..... 200301681

(51) Int. Cl.
*B21F 27/10* (2006.01)
*B21F 25/00* (2006.01)

(52) U.S. Cl.
USPC ..... 245/11; 245/2; 245/5

(58) Field of Classification Search ..... 256/2, 8, 256/5, 45, 21, 46; 140/58, 67, 112; 245/3, 245/7, 8, 11, 1
See application file for complete search history.

(56) References Cited

U.S. PATENT DOCUMENTS

| | | | | | |
|---|---|---|---|---|---|
| 285,979 | A | | 10/1883 | Dodge | |
| 379,729 | A | * | 3/1888 | Rodden | 256/6 |
| 496,974 | A | * | 5/1893 | Guilleaume | 256/6 |
| 1,434,051 | A | | 10/1922 | Elliot et al. | |
| 2,660,406 | A | | 11/1953 | Brickman | |
| 3,454,261 | A | * | 7/1969 | Nachazel | 256/2 |
| 3,550,911 | A | * | 12/1970 | Burton | 256/7 |
| 3,720,055 | A | * | 3/1973 | de Mestral et al. | 57/248 |
| 5,577,712 | A | * | 11/1996 | White, Jr. | 256/7 |
| 6,607,184 | B2 | * | 8/2003 | Brown | 256/2 |
| 2002/0070378 | A1 | * | 6/2002 | Brown | 256/2 |
| 2007/0138454 | A1 | * | 6/2007 | Yeo | 256/2 |

FOREIGN PATENT DOCUMENTS

| | | |
|---|---|---|
| FR | 2590113 | 5/1987 |
| GB | 191113653 | 2/1912 |

OTHER PUBLICATIONS

International Search Report.

* cited by examiner

*Primary Examiner* — Bobby Muromoto, Jr.
(74) *Attorney, Agent, or Firm* — Stephen H. Eland; Dann, Dorfman, Herrell & Skillman

(57) ABSTRACT

A barbed-type mesh is primarily intended to be used to protect young trees from livestock or other animals. The mesh is made from wires or electrowelded bars having sharp points on the surface thereof. The sharp points are electrowelded at intersections of the mesh.

14 Claims, 1 Drawing Sheet

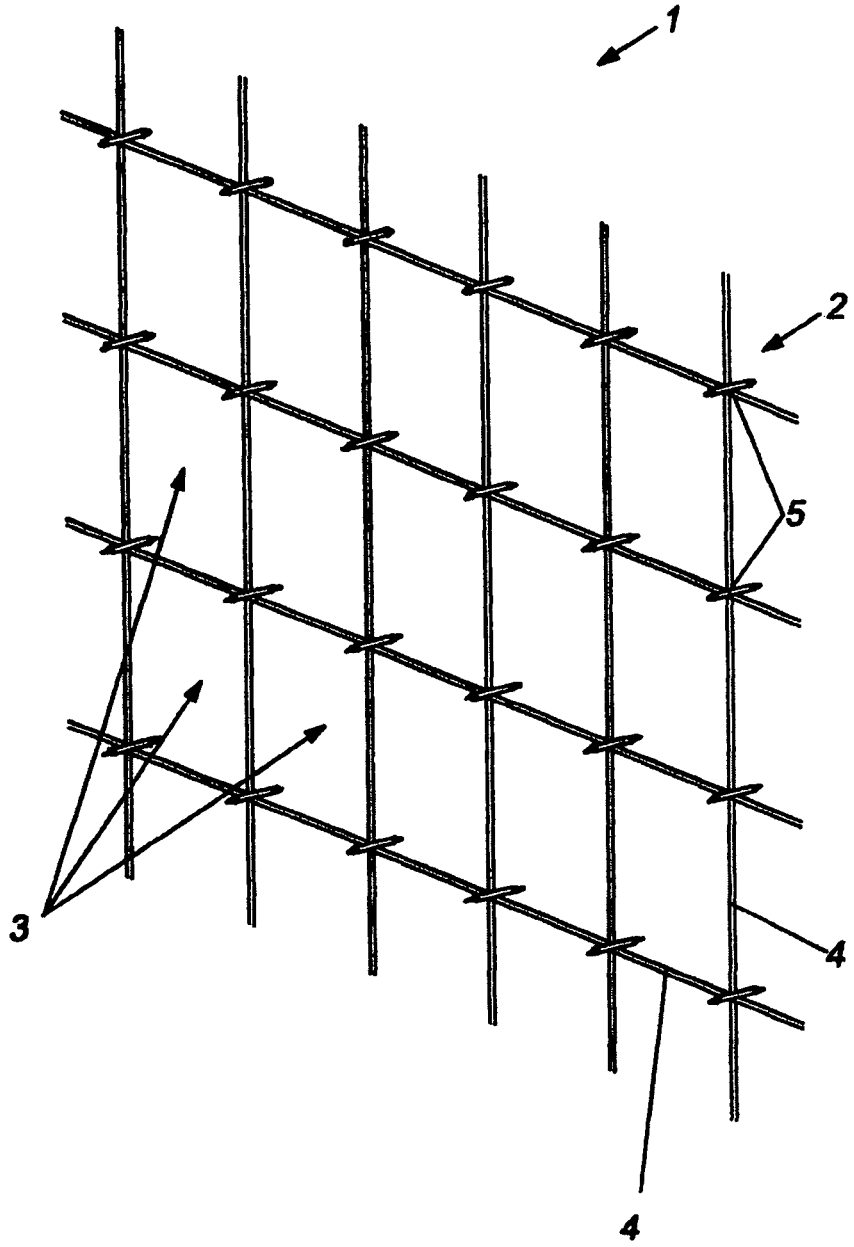
1
2
5
3
4
4

BARBED-TYPE MESH

CROSS REFERENCE TO RELATED APPLICATIONS

Applicant claims priority under 35 U.S.C. §119 of Spanish Application No. P 2003 01681 filed Jul. 11, 2003. Applicants also claims priority under 35 U.S.C. §365 of PCT/ES2004/000306 filed Jun. 30, 2004. The international application under PCT article 21(2) was not published in English.

OBJECT OF THE INVENTION

The present invention relates to a barbed-type mesh

BACKGROUND OF THE INVENTION

In areas of forest pasture, livestock and game frequently eat the leaves and shoots of young trees up to a height of around two meters, often preventing the regeneration of the trees.

To prevent this, the landowners often erect cages around the young trees that usually comprise a covering structure, using all types of materials; works meshes, electrowelded mesh, grills, wooden stakes and boards, normal metallic material, semirigid metallic livestock material, chicken wire, etc., with the structure formed from corrugated iron bars, PNL stakes or wooden stakes.

Once the cage has been constructed, it has to be covered with barbed wire to prevent the livestock or game from scratching at the cage eventually pushing it over. This makes the operation more expensive, as it requires more material and more manpower to set it up, making it almost impossible to reuse this cage with another tree as it is difficult and costly to disassemble it.

Therefore, although in practice, several types of protector are used, all are homemade and there is currently no specific product for this end.

This problem could be minimized if there a rigid or semirigid material existed that was barbed and that could serve to cover a structure of stakes and crossbars.

A wide range of metallic or meshes plastic meshes and bars and metallic nets are available on the market, obtained from electrolytic processes or other processes, of the "flat" type that can be used for the ends described, but none of them are of the barbed types (sclerophyllic), all of them being smooth, and so they do not perform the function for which the sclerophyllic mesh is designed.

The only barbed mesh that exists is military, made from braided barbed wire, but it is not flat, occupies a large volume and is not indicated for the ends of sclerophyllic mesh.

There are also models of forest protectors for smaller game and/or roe deer, although these are ineffective against livestock or larger game, as they are not barbed.

DESCRIPTION OF THE INVENTION

The use of "sclerophyllic mesh" has the advantages of normal metallic material, of the rigid and semirigid type, which having a certain hole size prevents the livestock from putting their head through and eating the tree, and those of barbed wire, that, on being barbed, prevent the livestock from rubbing against them and knocking over the cage or breaking it.

In accordance with the invention, the sclerophyllic mesh is an electrowelded mesh, consisting of wire or metal bars, which can be of any thickness or diameter, with any type of cross-section, whether circular, square, rectangular, pentagonal or any other. The mesh can be formed by materials of different thicknesses and these can be distributed in any form in the sheets in which the mesh is made.

This mesh can present polygons of any form, and the holes can be of any size, and can be formed a polygons of one or several shapes and sizes. The distribution of the squares in the mesh can be of any type.

This mesh will have some sharp points or points on its surface, or surfaces, such that it is sclerophyllic, where the sharp points can be of the same material as the mesh or of any other, and can be joined to the mesh by electrowelding, braiding, or any other system, and can be placed in any way, either at the vertices of the mesh, or at any other point, and they can be arranged in several forms, having any density and distribution, homogeneous or not.

The arrangement of the sharp points will be facing one side or both, and the sharp points can have any type of section or any length.

The orientation of the sharp points with respect to the mesh can be perpendicular, oblique, or any other.

The sharp points can be straight or curved, individual or multiple, single or braided, or of any other type.

The manufacturing process of the mesh will be by electrowelding, such that a flat, rigid or semirigid mesh is obtained that is barbed. The mesh will be produced in sheets of any size. The sheets can have any distribution of squares of the mesh with respect to its edges, which can have any type of finish.

The sclerophyllic mesh allows any type of prism.

In this fashion, the sclerophyllic mesh offers the advantages of normal metallic material of the rigid or semirigid type, which because it has a certain hole size prevents the livestock from sticking their heads through and eating the tree, and the barbed wire, which because it is barbed, prevents the livestock from rubbing against it and knocking over the cage or breaking it.

Although the main use foreseen for the mesh is the one presented above, other possible uses are not discarded, such as pastoral farming, industrial or urban uses.

BRIEF DESCRIPTION OF THE DRAWINGS

FIG. 1 shows a view of an example of an embodiment of the esclerofila mesh of the invention.

DESCRIPTION OF A PRACTICAL EMBODIMENT OF THE INVENTION

The sclerophyllic mesh 1 of the invention is comprised of a flat mesh 2 formed from polygons 3 of any shape or size, made by electrowelding from metallic material 4.

At the nodes of the mesh, in this example of an embodiment, sharp points 5 are attached by any means that can be of any length and any type of material, which can present any distribution, density, and arrangement with respect to the plane of the mesh.

With the nature of the invention sufficiently described, as well as a practical embodiment thereof, it should be stated that the details of the arrangements indicated previously and represented in the attached drawings can be modified without altering the basic principle.

The invention claimed is:

1. A sclerophyllic mesh forming a sheet with two opposite face sides and being made from electrowelded metallic wires or bars having intersections with each other, and said mesh further comprising sharp points electrowelded to said intersections of said metallic bars or wires, wherein each sharp point protrudes from one side of the mesh.

2. The sclerophyllic mesh according to claim 1, wherein each sharp point protrudes obliquely.

3. The sclerophyllic mesh according to claim 1, wherein each sharp point protrudes perpendicularly.

4. The sclerophyllic mesh according to claim 1, wherein each sharp point is straight.

5. The sclerophyllic mesh according to claim 1, wherein each sharp point is curved.

6. The sclerophyllic mesh according to claim 1, wherein the mesh is formed by polygons other than squares.

7. A sclerophyllic mesh forming a sheet with two opposite face sides, said mesh being made of electrowelded metallic bars or wires having intersections with each other, and said mesh further comprising sharp points electrowelded to the intersections of said metallic bars or wires, and wherein a first part of each sharp point protrudes from one side of the mesh and a second part of each sharp point protrudes from the opposite side of the mesh.

8. The sclerophyllic mesh according to claim 7, wherein each sharp point protrudes obliquely.

9. The sclerophyllic mesh according to claim 7, wherein each sharp point protrudes perpendicularly.

10. The sclerophyllic mesh according to claim 7, wherein each sharp point is straight.

11. The sclerophyllic mesh according to claim 7, wherein each sharp point is curved.

12. The sclerophyllic mesh according to claim 7, wherein the mesh is formed by polygons other than squares.

13. The sclerophyllic mesh according to claim 1, wherein the sharp points are made from a different material than that of the metallic bars or wires.

14. The sclerophyllic mesh according to claim 7, wherein the sharp points are made from a different material than that of the metallic bars or wires.

* * * * *